United States Patent [19]

Michaels

[11] Patent Number: 4,754,964

[45] Date of Patent: Jul. 5, 1988

[54] ARM WRESTLING TRAINING MACHINE

[76] Inventor: Gilbert N. Michaels, 2451 Briarcrest Rd., Beverly Hills, Calif. 90210

[21] Appl. No.: 19,292

[22] Filed: Feb. 26, 1987

[51] Int. Cl.[4] ..... A63B 21/00

[52] U.S. Cl. ..... 272/67; 272/901; 272/DIG. 4; 272/130; 272/135

[58] Field of Search ..... 272/93, 135, 136, 138, 272/901, 67, 130, DIG. 4

[56] References Cited

U.S. PATENT DOCUMENTS

| | | | |
|---|---|---|---|
| 3,563,542 | 2/1971 | Wellman | 272/135 |
| 4,068,843 | 1/1978 | Frost | 272/901 |
| 4,129,297 | 12/1978 | Dolan | 272/901 |
| 4,184,675 | 1/1980 | Rogerson | 272/901 |
| 4,214,748 | 7/1980 | Blackmon | 272/136 X |
| 4,575,076 | 3/1986 | Reichert et al. | 272/901 |
| 4,603,859 | 8/1986 | Schnaitl | 272/901 |
| 4,684,125 | 8/1987 | Lantz | 272/130 |

FOREIGN PATENT DOCUMENTS

| | | | |
|---|---|---|---|
| 2716046 | 10/1978 | Fed. Rep. of Germany | 272/901 |

*Primary Examiner*—Richard J. Apley
*Assistant Examiner*—J. Welsh
*Attorney, Agent, or Firm*—Philip D. Junkins

[57] ABSTRACT

A portable arm wrestling training machine including an elongated, longitudinally-extending supporting frame suitable for placement on a table top and a mechanical wrestling arm assembly pivotally affixed at its lower end to the supporting frame and bearing at its upper end a handgrip member for hand grasp engagement by the wrestling arm hand of a training arm wrestler. The arm assembly is rotatable between a substantially horizontal position adjacent the frame and a substantially vertical position and is provided with a force-biasing mechanism which applies a pivot resistive force to the arm assembly tending to maintain the arm assembly in its vertical position. The mechanical wrestling arm assembly and force-biasing mechanism cooperate to simulate in movement and force pattern the defensive arm movement and resistive forces of an experienced arm wrestler in opposition to the arm rotational forces applied to the arm assembly by the arm wrestling trainee. The training machine is versatile in that it may be used by either a right handed or left handed user and the supporting frame of the machine is provided with right and left elbow cups and a handgrip post for grasping engagement by the other hand of the training arm wrestler.

6 Claims, 3 Drawing Sheets

FIG. 1.
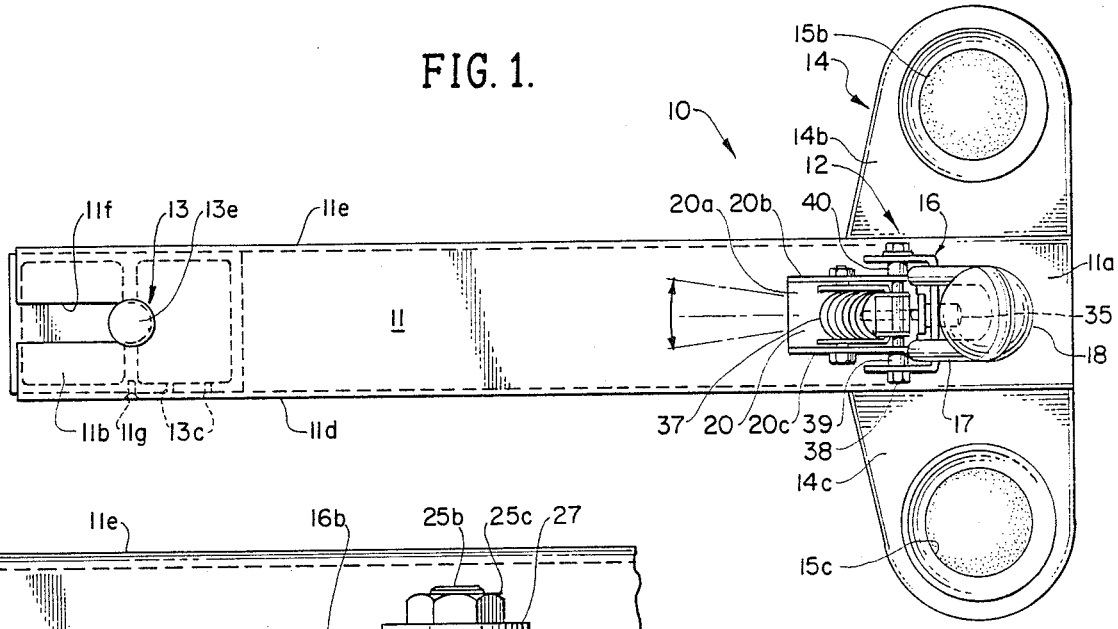
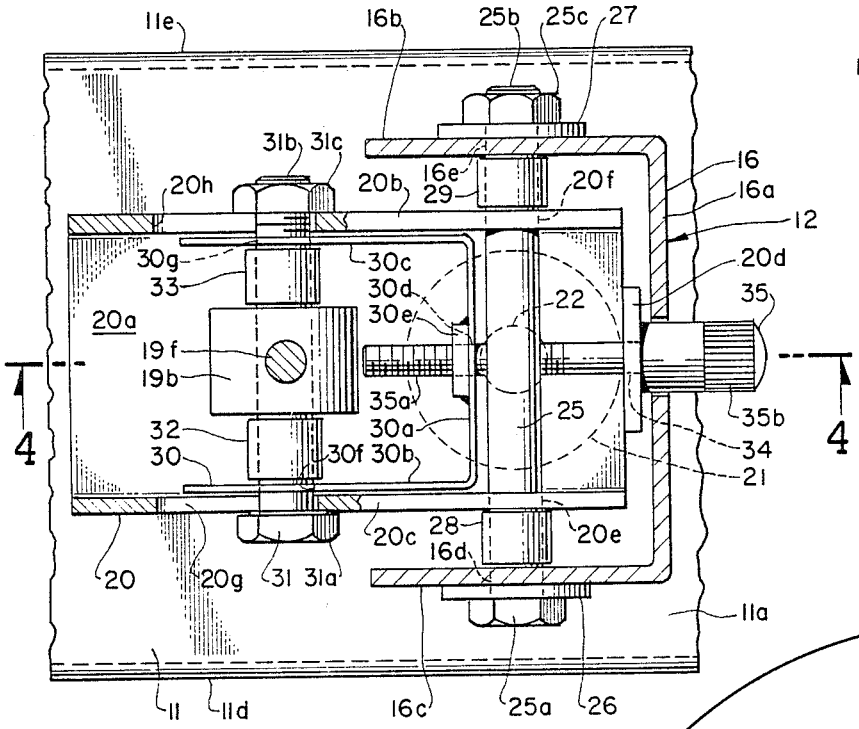
FIG. 3.
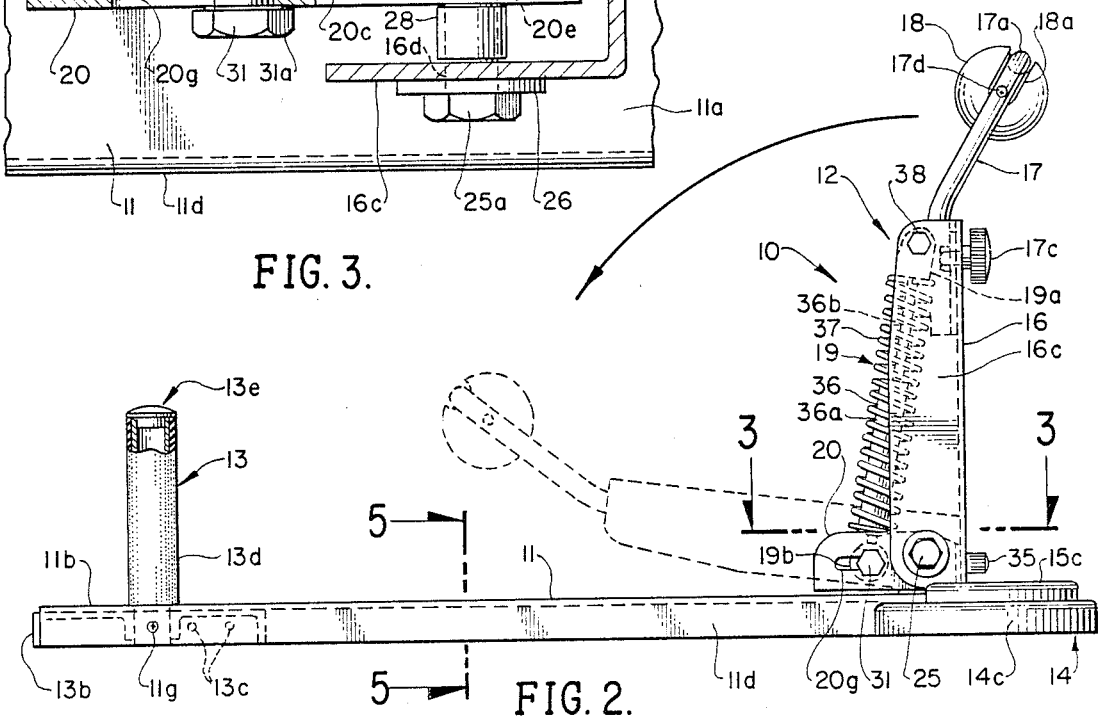
FIG. 2.

ARM WRESTLING TRAINING MACHINE

BACKGROUND OF THE INVENTION

This invention relates to the competitive sport of arm wrestling which has attracted great interest in recent years and is expected to increase in number of competitors in the future, both amateur and professional. Historically, arm wrestling first developed as a recreational, ego-building pastime between pairs of individuals boasting as to their respective upper body arm, shoulder, forearm, wrist and hand grip strength.

In its most unsophisticated form, the sport involves the use of the right or left arm of a pair of arm wrestling competitors with the elbow of each opponent positioned on a flat surface, in relatively close proximity to the other's elbow. The forearm of each opponent extends vertically upward with the hand of each opponent maintained in tightly clasped relationship with the hand of the other. The objective of each competitor in each arm wrestling match is to force (rotatively) the forearm of the opponent rearwardly into a substantially horizontal position and to the point whereat the clasped hands touch the flat arm wrestling surface or other win object (pad, etc.). With their free hand each competitor grasps a fixed obJect, associated with the arm wrestling surface, to provide stability to their upper body during the arm wrestling match. The wrestling surface may comprise a table top when the competitors are sitting or a raised table surface when the competitors are standing. The fixed object for providing body stability may comprise the edge of the table or a handgrip post or other grip object affixed to the table top.

As the sport of arm wrestling became better known and more sophisticated, local and national tournaments were arranged and high monetary rewards developed for winners and champions at different weight classifications andlevels of competence. With such sophistication there developed standards for, and rules of, competition and standardization of tournament tables including height specification, elbow cup utilization and spacing, win-lose signal systems, and handgrip design and spacing. Throughout its transition from a recreational pastime to a recognized national and international competitive sport, arm wrestling skill development has relied upon direct paired competition and the use of individualized upper body development equipment including weights, dumbbells, hand crunchers and exercise machines.

It is a principal object of the present invention to provide a mechanical arm wrestling machine for use by an individual to develop arm wrestling skills.

It is another object of the invention to provide a mechanical arm wrestling machine, simulating the arm movement and resistive forces of an experienced arm wrestler for use by an individual as an exercise and training device to develop arm wrestling strength, endurance and techniques.

It is a further object of the invention to provide a mechanical arm wrestling machine, simulating the arm movement and resistive forces of an experienced arm wrestler, for use by an individual to develop either right and/or left arm wrestling skills.

It is yet another object of the invention to provide an arm wrestling training machine, including a mechanical arm presenting adjustable resistive forces, for use by an individual to develop arm wrestling strength, endurance and techniques.

Other objects and advantages of the present invention will be apparent from the following summary and detailed description of the invention, taken with the accompanying drawing figures.

SUMMARY OF THE INVENTION

The present invention relates to an arm wrestling machine for use by an individual (man, woman or child, amateur or professional) as an exercise and training device to develop arm wrestling strength, endurance and techniques. The machine has as its principal structural element an elongated, longitudinally-extending frame member which carries at one end a pivotally supported mechanical wrestling arm assembly which is force-biased to a vertical position and simulates in movement and force pattern the defensive arm movement and resistive forces of an experienced arm wrestler. Affixed to the elongated frame member at the same end is a transversely-extending cross-frame member having outboard frame portions which provide transverse stability to the arm wrestling machine during its use and which include right and left elbow cups. At the other end of the elongated frame member there is provided a handgrip post which may be adjustably positioned on such frame to change its distance from the mechanical wrestling arm assembly to suit the size of the arm wrestling trainee. The arm wrestling machine of the invention may be positioned on a low table for seated use by the trainee or on a high table for stand-up use.

The force-biased mechanical wrestling arm assembly includes: a main arm member, pivoted at its lower end to a swivel bracket mounted on the elongated frame member; an arm extender adjustably mounted to the main arm member and bearing at its terminal end a handgrip member simulating an opposing arm wrestler hand grip; and a force-biasing mechanism providing appropriate resistive force to the mechanical wrestling arm assembly to simulate the opposing defensive resistive force of an experienced arm wrestler. The force-biasing mechanism is pivotally connected at its upper end to the upper end of the main arm member of the mechanical wrestling arm assembly and is pivotally connected at its lower end to the swivel bracket (mounted on the elongated frame member) by an axle adjustably positioned with respect to the swivel bracket (fixed postion) axle about which the wrestling arm assembly pivots at its lower end. Adjustable positioning of the lower force-biasing mechanism axle changes the resistive force applied by such mechanism in opposition to the arm wrestling force applied by the user of the arm wrestling training machine of the invention. The force-biasing mechanism may be comprised of a hydraulic compression cylinder, such as a shock absorber, encircled by a heavy force coil spring. As the length of the force-biasing mechanism is increased, through adjustment of the position of the lower axle of such mechanism in the swivel bracket, the resistive force applied to the upper end of the wrestling arm assembly by the force-biasing mechanism is decreased.

The mechanical arm wrestling machine of the invention provides a starting, an amatuer or a professional arm wrestler with a unique training and exercising device for individually developing arm wrestling strength, endurance and techniques. The machine simulates the defensive arm movements and forces of an experienced arm wrestler with the defensive force level applied by the mechanical wrestling arm assembly of the machine being adjustable to provide more or less defensive force against the arm wrestler trainee.

BRIEF DESCRIPTION OF THE DRAWING FIGURES

The invention is illustrated in the accompanying drawing figures in which:

FIG. 1 is a top view of the arm wrestling training machine of the invention;

FIG. 2 is a side elevation view of the arm wrestling training machine of FIG. 1;

FIG. 3 is a partial top section view of the mechanical wrestling arm of the training machine of the invention taken along line 3—3 of FIG. 2 showing, particularly, the support and compression adjustment mechanisms associated with the lower pivot end of the mechanical wrestling arm;

DETAILED DESCRIPTION OF THE INVENTION

Figure 4:
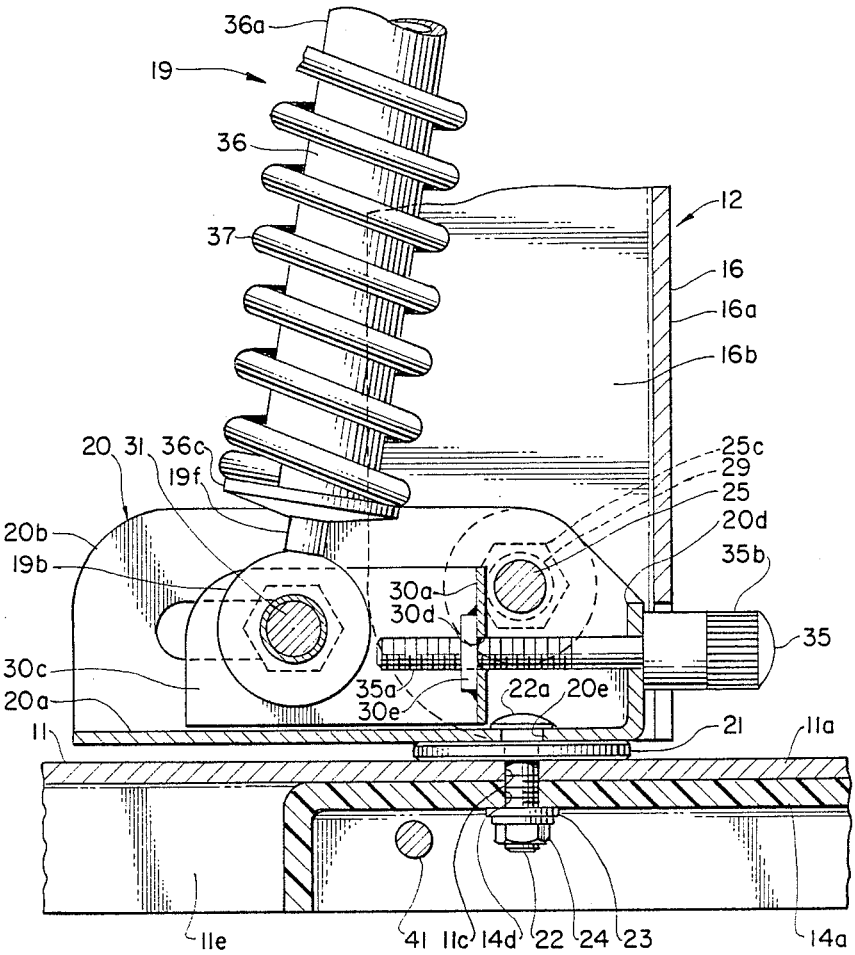
FIG. 4 is a partial side section view of the lower pivot end of the mechanical wrestling arm of the invention taken along line 4—4 of FIG. 3.
Figure 5:
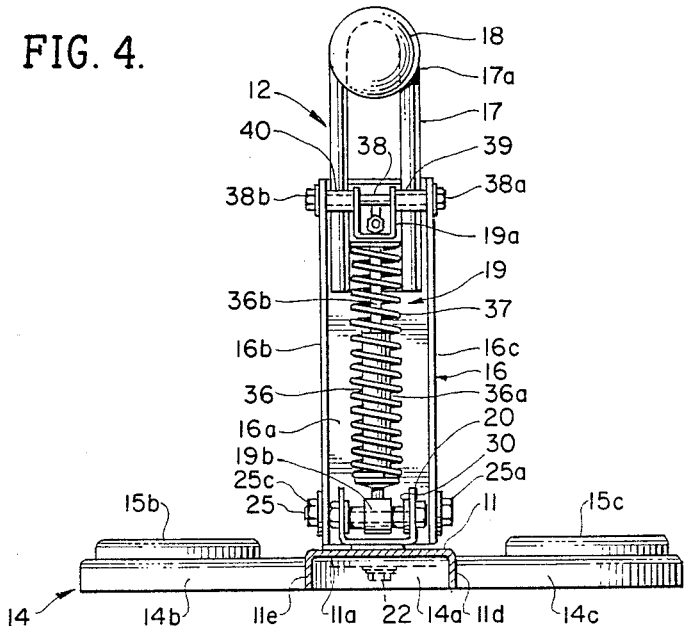
FIG. 5 is an end elevation view of the arm wrestling training machine of FIG. 1 and FIG. 2 taken along line 5—5 of FIG. 2 in the direction of the arrows toward the mechanical wrestling arm of the training machine.

A preferred embodiment of the arm wrestling training machine of the invention is shown in FIGS. 1 through 6 on the drawing sheets. The machine, generally indicated by the numeral 10, has as its principal structural element an elongated, longitudinally-extending body channel or frame member 11 and carries at its end 11*a* a pivotally supported, force-biased mechanical wrestling arm assembly 12 and at its opposite end 11*b* a handgrip post 13. Affixed to body member 11 at end 11*a* is a transversely-extending cross-frame member 14 having a central frame portion 14*a* and outboard frame portions 14*b* and 14*c*. The outboard frame portions 14*b* and 14*c* provide transverse stability to the arm wrestling training machine during its use and each outboard frame portion 14*b* and 14*c* includes an elbow cup 15*b* and 15*c*, respectively.

The mechanical wrestling arm assembly 12, pivotally supported on frame member 11 at its end 11*a*, is comprised of: pivotal main arm member or channel 16 (including principal wall 16*a* and side walls 16*b* and 16*c*); an arm extender 17 adjustably mounted to the channel's principal wall 16*a* at its upper end and bearing at its terminal end 17*a* a handgrip member 18; and a force-biasing mechanism 19, pivotally connected at its upper end to the upper end of the main arm member 16 and pivotally connected at its lower end to a swivel bracket 20 mounted on frame member 11. The swivel bracket 20 includes a base wall 20*a*, upwardly extending side walls 20*b* and 20*c*, and an upwardly extending end wall 20*d* as best viewed in FIGS. 4 and 6. Bracket 20 rests upon a washer 21 with such bracket and washer positioned on and mounted to frame member 11 by bolt 22 which extends from its head portion 22*a* through hole 20*e* in the base wall 20*a* of the bracket, washer 21, hole 11*c* in frame member 11 and hole 14*d* in crossframe member 14. Bolt 22 is maintained in its mounting and pivot axis relationship with swivel bracket 20 by lock washer 23 and lock nut 24.

The main arm member or channel 16 of the mechanical wrestling arm assembly 12 is pivoted at its lower end to swivel bracket 20 by bolt 25 which extends from its head end 25*a* (see particularly FIG. 3) through hole 16*d* in channel side wall 16*c*, hole 20*e* in the side wall 20*c* of bracket 20, hole 20*f* in side wall 20*b* of bracket 20, and hole 16*e* in channel side wall 16*b* to its threaded end 25*b*. Bolt 25 is maintained in its mounting and pivot axis relationship with main arm member 16 by lock nut 25*c*. Appropriate alignment of arm member or channel 16 with respect to swivel bracket 20 is maintained by outer locking washers 26 and 27 and spacer members 28 and 29 placed on bolt 25 and positioned between channel wall 16*c* and bracket wall 20*c* and channel wall 16*b* and bracket wall 20*b*, respectively.

The swivel bracket 20 includes a longitudinally positionable U-shaped member 30 for adjusting the resistive force applied by the force-biasing mechanism 19 to the mechanical wrestling arm assembly 12. The U-shaped member 30 includes a rear base portion 30*a* and forwardly-extending leg portions 30*b* and 30*c*. The rear portion 30*a* has a central opening 30*d* and bears a threaded nut 30*e* welded in position about the opening 30*d* (see particularly FIGS. 3 and 4). Member 30 is provided with mutually aligned holes 30*f* and 30*g* in leg portions 30*b* and 30*c*, respectively, through which there extends a pivot bolt 31. Bolt 31 extends from its head end 31*a* through slot 20*g* in side wall 20*c* of swivel bracket 20, hole 30*f* in leg portion 30*b* of U-shaped member 30, the lower pivot member 19*b* of the force-biased mechanism 19, hole 30*g* in leg portion 30*c* of U-shaped member 30, and slot 20*h* in side wall 20*b* of swivel bracket 20 to its threaded end 31*b*. Bolt 31 is maintained in its mounting and pivot axis relationship with U-shaped member 30 and pivot member 19*b* by lock nut 31*c*. Appropriate alignment of pivot member 19*b* within the leg portions 30*b* and 30*c* of the U-shaped member 30 is accomplished by spacers 32 and 33 placed on bolt 31 and positioned between leg portions 30*b* and pivot member 19*b* and between pivot member 19*b* and leg portion 30*c*, respectively.

Extending through an opening 34 in end wall 20*d* of swivel bracket 20 is a force adjustment member 35 including a threaded shank portion 35*a* and a knurled enlarged head portion 35*b* which abuts with wall 20*d* of bracket 20. The threaded shank portion 35*a* of force adjustment member 35 extends from opening 34, below bolt 25 of bracket 20, and threads into nut 30*e* of the base portion 30*a* of U-shaped bracket 30. By rotational adjustment of member 35 the U-shaped bracket 30 bearing bolt 31 and pivot member 19*b* is drawn toward or moved away from the end wall 20*d* of swivel bracket 20, the bolt 31 being thereby variously positioned within the slots 20*g* and 20*h* of the side walls 20*c* and 20*b*, respectively, of such bracket with resultant adjustment of the resistive force applied by the force-biasing mechanism 19 to the mechanical wrestling arm assembly 12. The resistive force of mechanism 19 continuously applies heavy pressure through pivot member 19*b* to bolt 31 and U-shaped member 30 thereby maintaining the head portion 35*b* of the force adjustment member 35 in its abutment position with respect to end wall 20*d* of bracket 20.

The force-biasing mechanism 19, as previously indicated, is pivotally connected at its upper end to the upper end of the main arm member 16 of the mechanical arm assembly 12 and is pivotally connected at its lower end to the swivel bracket 20 mounted on frame member 11. Mechanism 19 is comprised of a hydraulic compression unit 36 (such as a shock absorber) and an encircling heavy force coil spring 37. The compression unit includes an outer cylinder 36*a* and an inner piston arrangement, of well known design, with hydraulic fluid on each side of the piston providing a fluid system highly resistive to piston movement. The piston is provided with a force rod 36*b* extending external to the cylinder 36*a*. As utilized in the present force-biasing mechanism 19 the rod 36*b* of compression unit 36 extends upwardly from cylinder 36*a* and has removably affixed to its end an upper pivot member 19*a* provided with a base portion 19*c* and leg portions 19*d* having pivot holes 19*e*. The upper pivot member 19*a* of compression unit 36 is pivotally interconnected with the upper end of arm channel 16 through bolt 38 extending through pivot holes 16*f* and 16*g* in channel side walls 16*c* and 16*b*, respectively, and pivot holes 19*e* of member 19*a*. The bolt 38 (including its head portion 38*a*) is maintained in its appropriate position by nut 38*b* and spacer members 39 and 40. The lower end of hydraulic unit 36 is sealed and includes a bottom flange portion 36*c* to which is affixed lower pivot member 19*b* (via pivot stem 19*f*).

The heavy force coil spring 37 of the force-biasing mechanism 19, which encircles the hydraulic compression unit 36, extends under compression between the base portion 19*c* of the upper pivot member 19*a* and the bottom flange portion 36*c* at the lower end of the outer cylinder 36*a* of hydraulic compression unit 36. The resistive force of the hydraulic compression unit 36 and the resistive force of the encircling coil spring 37 combine to provide the heavy bias force applied to the upper end of the mechanical wrestling arm assembly 12 of the arm wrestling training machine 10 of the present invention in opposition to the arm force applied to such arm by a person using the machine as a training device. With the positionable U-shaped member 30 of the swivel bracket 20 adjusted (by member 35) as shown in FIG. 3 the coil spring is shortened to the greatest adjustable degree possible whereby additional turning force by the trainee is required at the upper end of the wrestling arm assembly 12 to overcome the resistive force of the force-biasing mechanism 19. With the positionable U-shaped member 30 adjusted to a position to the left of the position shown in FIG. 3 the coil spring 37 is lengthened relieving it of some of its compression force whereby a reduced level of turning force by the trainee is required to overcome the resistive force of the force-biasing mechanism 19 of the mechanical wrestling arm assembly.

Figure 6:
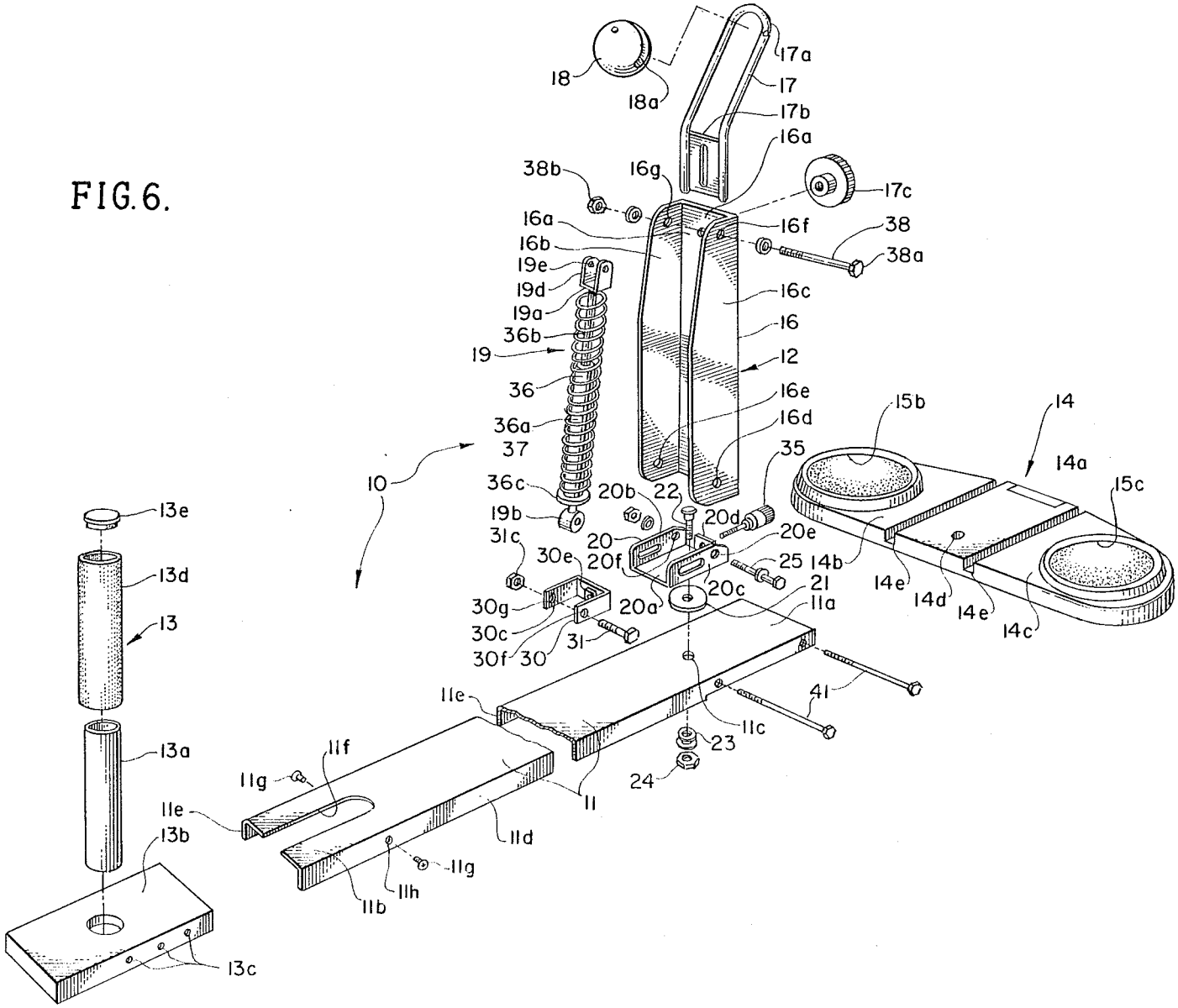
FIG. 6 is an exploded perspective view of the arm wrestling training machine of the invention showing the components of the machine in aligned relationship before assembly.

As previously indicated, the principal structural or support element of the arm wrestling training machine of the present invention is a longitudinally-extending body channel or frame member 11 to which is affixed at its end 11*a* a transversely extending cross-frame member 14. The frame member 11 may be formed of extruded aluminum with the cross-frame member 14 formed of an aluminum casting or as a molding of structural foam plastic material. As shown in FIG. 6 these structural elements may be joined by bolt connection using bolts 41 extending through mating holes in the walls of channels 14*e* of cross-frame member 14 and the channel walls 11*d* and 11*e* of frame member 11. The elbow cups 15*b* and 15*c* may be formed as part of the cross-frame member 14 aluminum casting or plastic molding and may be coated with a relatively softer elbow interface material (felt, rubber, etc.).

The arm extender 17, providing adjustable extension of the length of the mechanical wrestling arm assembly, includes at its lower end a sloted plate 17*b* which is adjustably bolted to the upper end of channel wall 16*a* by adjusting bolt assembly 17*c* to provide such adjustable extension capability to match arm lengths of users of the arm wrestling training machine 10. The handgrip member 18, as shown in FIGS. 1, 2, 5 and 6, is a sphere including a groove 18*a* so that such sphere may be positioned with relatively smooth and hand compatible contour within the terminal end 17*a* of arm extender 17. The handgrip spherical member 18 may be removably maintained in its seated position within the terminal end 17*a* of extender 17 by one or more set screws 17*d*.

The handgrip post 13 at end 11*b* of the body or frame member 11 may be comprised of a pipe member 13*a* affixed in known manner to a support member 13*b* which is adjustably positionable along the end portion 11*b* of frame member 11. The support member 13*b* slides within the channel 11 with the pipe member 13*a* extending upwardly through slot 11*f* of the body or frame member 11. When the support member 13*b* is appropriately positioned, set screws 11*g* are introduced through holes 11*h* in channel walls 11*d* and 11*e* and threaded into matching holes 13*c* of support member 13*b*. The pipe member 13*a* of handgrip post 13 may include a covering material 13*d* of relatively soft grip material and a cap member 13*e*.

In operation, the arm wrestling training machine comprising the present invention is placed on a table top in front of a sitting arm wrestling trainee or on a raised table surface when the trainee is standing. In competitive arm wrestling matches the pair of competitors stand one on each side of a raised table. With the training machine 10 oriented as shown in FIG. 1, a right handed arm wrestler trainee places his or her right elbow in elbow cup 15*c* and grasps the handgrip member 18 of the mechanical wrestling arm assembly 12 with the right hand. The arm wrestler grasps the handgrip post 13 with the left hand so that the training machine 10 is stabilized on the table top and so that the body, arm and hand positions of the trainee are in the competitive ready state. The wrestler then applies his or her full rotational right arm force to the mechanical wrestling arm assembly 12 to force rotate the arm assembly from its substantially vertical position to a substantially horizontal position (as shown in phantom outline in FIG. 2) in opposition to the resistive force of the force-biasing mechanism 19. In the case of a left handed arm wrestler trainee, such trainee places his or her left elbow in the elbow cup 15*b* and grasps the handgrip member 18 of the mechanical wrestling arm assembly with the left hand. The left handed trainee grasps the handgrip post 13 with the right hand.

To further simulate the defensive movement and resistive force pattern of an experienced arm wrestler, the mechanical wrestling arm assembly 12 of the arm wrestling training machine 10 is pivoted at its lower end to swivel bracket 20 mounted on the body frame 11. Such mounting of the arm assembly permits limited rotation of the arm assembly 12 from direct alignment with the longitudinal axis of the frame member 11 as it is forced from its vertical orientation toward a horizontal orientation (see FIG. 1).

The arm wrestling training machine of the invention may be provided with a pin-win pad (of known design) which is adjustably positioned on the central portion of the body frame 11. Such a pad (not shown) may include a win signal means (buzzer, etc.) which sounds at the instant the arm wrestler trainee rotates the force-biased mechanical wrestling arm assembly 12 to its near horizontal position with the handgrip member 18 or hand of the trainee touching the pad.

Thus, there is provided through the present invention a portable mechanical arm wrestling training machine, simulating the defensive arm movement and resistive forces of an experienced arm wrestler, for use by an individual to develop arm wrestling strength, endurance and techniques. By adjustment of the force-biasing mechanism of the machine, variable settings of rotational resistive forces may be applied by the mechanical wrestling arm assembly of the invention. The length of the arm assembly may be adjusted to meet the requirements of the user and the position of the body stabilizing handgrip post may be varied.

While the invention has been described in connection with a particular structural embodiment of an arm wrestling training machine, many modifications of the apparatus will be apparent to those skilled in the art. Accordingly, such modifications are to be included within the spirit and scope of the invention as defined by the following claims.

What I claim is:

1. An arm wrestling training machine comprising: an elongated, longitudinally-extending frame member suitable for placement on a table top; a swivel bracket mounted on one end of said elongated frame member and adapted to be rotatable thereon; a mechanical wrestling arm assembly pivotally affixed at its lower end to said swivel bracket to provide approximately 90° of rotational movement of said arm assembly between a substantially horizontal position adjacent said frame member and a substantially vertical position with respect to said frame member, said assembly bearing at its upper end a first handgrip means for hand grasp engagement by the wrestling arm hand of a training arm wrestler; force-biasing means pivotally affixed at its lower end to said swivel bracket and pivotally affixed at its upper end to the upper end of said arm assembly, said force-biasing means applying a pivot resistive force to said arm assembly and tending to maintain said arm assembly and force-biasing means cooperating to simulate in movement and force pattern the defensive arm movement and resistive forces of an experienced arm wrestler; and a second handgrip means affixed to the other end of said elongated frame member for hand grasp engagement by the other hand of the training arm wrestler.

2. An arm wrestling training machine as claimed in claim 1 wherein there is affixed to the elongated, longitudinally-extending frame member at its end proximate the mechanical wrestling arm assembly a transversely-extending, cross-frame member bearing on each side thereof an elbow cup for right or left side placement of the elbow of the wrestling arm of the training arm wrestler.

3. An arm wrestling training machine as claimed in claim 1 wherein the swivel bracket includes means for adjusting the distance between the position whereat the mechanical wrestling arm assembly is pivotally affixed to said bracket and the position whereat the force-biasing means is pivotally affixed to said bracket thereby adjusting the level of pivot resistive force applied to the mechanical wrestling arm assembly by said force-biasing means whereby the resistive forces of said arm assembly to movement by the training arm wrestler are increased or decreased.

4. An arm wrestling training machine as claimed in claim 1 wherein said first handgrip means is adjustably positionable with respect to the mechanical wrestling arm assembly whereby the effective length of said arm assembly and said handgrip means may be increased or decreased.

5. An arm wrestling training machine as claimed in claim 1 wherein said second handgrip means is adjustably positionable along said elongated frame member at the other end thereof.

6. An arm wrestling training machine as claimed in claim 1 wherein said force-biasing means associated with the mechanical wrestling arm assembly comprises a hydraulic cylinder encircled by a heavy force coil spring.

* * * * *